US007765986B2

(12) United States Patent
Cho et al.

(10) Patent No.: US 7,765,986 B2
(45) Date of Patent: Aug. 3, 2010

(54) INJECTOR MOUNTING STRUCTURE OF V-TYPE INTERNAL COMBUSTION ENGINE

(75) Inventors: Masaki Cho, Saitama (JP); Yosuke Ariga, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 336 days.

(21) Appl. No.: 11/978,721

(22) Filed: Oct. 30, 2007

(65) Prior Publication Data

US 2008/0141980 A1 Jun. 19, 2008

(30) Foreign Application Priority Data

Dec. 13, 2006 (JP) ..... 2006-335855

(51) Int. Cl.
*F02M 61/14* (2006.01)
*F02M 61/18* (2006.01)

(52) U.S. Cl. ..... 123/470; 123/54.4

(58) Field of Classification Search ..... 123/470, 123/468, 469, 456, 54.4, 184.31, 184.34
See application file for complete search history.

(56) References Cited

U.S. PATENT DOCUMENTS 4,534,322 A * 8/1985 Matsuda et al. ..... 123/54.4
5,577,477 A * 11/1996 Katoh ..... 123/456
6,305,354 B1 * 10/2001 Kato ..... 123/456
6,655,337 B2 * 12/2003 Hirano et al. ..... 123/184.31
7,086,364 B2 * 8/2006 Udono ..... 123/184.21
7,104,236 B2 * 9/2006 Ishikawa et al. ..... 123/184.31
2002/0170518 A1 * 11/2002 Hirano et al. ..... 123/184.31
2005/0045147 A1 * 3/2005 Ishikawa et al. ..... 123/336
2005/0066926 A1 * 3/2005 Ishikawa et al. ..... 123/184.34
2005/0188959 A1 * 9/2005 Udono ..... 123/470
2006/0042601 A1 3/2006 Hotta et al.

FOREIGN PATENT DOCUMENTS

JP 3106724 B2 9/2000
JP 2006-063855 A 3/2006

* cited by examiner

*Primary Examiner*—Mahmoud Gimie
(74) *Attorney, Agent, or Firm*—Birch, Stewart, Kolsch & Birch, LLP

(57) ABSTRACT

An injector mounting structure for a V-type internal combustion engine includes an intake manifold arranged in a V-bank. A fuel supply pipe extends linearly in parallel to a crankshaft and is disposed in the V-bank. A pair of injectors are branched in an inverted V-shape in side view from the direction of the axial line of the fuel supply pipe from two branch portions P, Q apart from each other in the direction of the axial line of the fuel supply pipe and extend in parallel to each other and obliquely at an acute angle α with respect to a segment PQ connecting the two branch portions P, Q in top view. The injectors are mounted by fitting distal end portions of the pair of injectors respectively into mounting holes formed on air-intake pipes of the intake manifold on the respective sides.

20 Claims, 7 Drawing Sheets

INJECTOR MOUNTING STRUCTURE OF V-TYPE INTERNAL COMBUSTION ENGINE

CROSS-REFERENCE TO RELATED APPLICATIONS

The present application claims priority under 35 USC 119 to Japanese Patent Application No. 2006-335855 filed on Dec. 13, 2006 the entire contents thereof is hereby incorporated by reference.

BACKGROUND OF THE INVENTION

1. Field of the Invention

The present invention relates to an injector mounting structure with respect to an air-intake device in a V-type internal combustion engine.

2. Description of Background Art

In the related art, for example, in a V-type internal combustion engine, with the arrangement of an air intake device for sucking air in respective cylinders at a V-bank between the cylinders, an intake manifold having a structure for branching a common air-intake passage to the respective cylinders as a branched air-intake passage is achieved, so that the air-intake device may be downsized and hence the bank angle may be reduced. See, for example, Japanese Patent No. 3106724 (FIG. 1).

In the V-type internal combustion engine disclosed in Japanese Patent No. 3106724, branched pipes as the branched air-intake passages extend respectively obliquely upwardly from respective air-intake ports which communicate with combustion chambers in cylinders on the respective sides which are inclined with respect to each other in a V-shape, collected together at the center, and are connected to a surge tank.

Disposed on both sides of the center collected portion are fuel supply pipes arranged in parallel to a crankshaft, and injectors on the respective sides attached at the proximal end portions thereof to the fuel supply pipes respectively projecting downwardly and are fitted into the respective branched pipes at the distal end portions thereof.

In this manner, the injector mounting structure disclosed in Japanese Patent No. 3106724 is a structure in which the injectors on the respective sides are mounted to the fuel supply pipes on the respective sides. Thus, the number of components is large. Therefore, the assembly work takes a lot of trouble and the assembleability has a problem to solve.

SUMMARY AND OBJECTS OF THE INVENTION

In view of such a problem, it is an object of the present invention to provide an injector mounting structure in a V-type internal combustion engine in which the number of components is small and which is superior in assembleability.

In view of the problems described above, an embodiment of the present invention provides a V-type internal combustion engine in which an intake manifold is arranged in a V-bank formed between the cylinders arranged on the respective sides so as to be inclined to form a V-shape for sucking air to the respective cylinders with an injector mounting structure of a V-type internal combustion engine. A fuel supply pipe, oriented in parallel to a crankshaft and extending linearly, is disposed in the V-bank wherein a pair of injectors are branched from two branch portions apart from each other in the direction of an axial line of the fuel supply pipe into an inverted V-shape in a side view from the direction of the axial line of the fuel supply pipe and extend in parallel to each other and obliquely at an acute angle with respect to a segment connecting the two branch portions in a top view. The injectors are mounted by fitting respective distal end portions of the pair of injectors respectively to mounting holes formed on air-intake pipes on the respective sides of the intake manifold.

In the injector mounting structure of a V-type internal combustion engine according to an embodiment of the present invention the mounting holes formed on the air-intake pipes on the respective sides are formed with water drain holes respectively.

According to an embodiment of the present invention, since the pair of injectors are branched from two branch portions apart from each other in the direction of an axial line of the fuel supply pipe into an inverted V-shape in a side view from the direction of the axial line of the fuel supply pipe, and extend in parallel to each other and obliquely at the acute angle with respect to the segment connecting the two branch portions in a top view, the injectors may be mounted by fitting the distal end portions of the respective injectors simultaneously to the respective mounting holes of the air-intake pipes on the respective sides while rotating the fuel supply pipe integrally with the pair of injectors about the center point of the segment in the direction of rotation in which the distal end portions of the injectors rotates ahead of the rear end portions thereof in top view.

Therefore, by providing the pair of the injectors so as to project from the single fuel supply pipe, the pair of injectors may be mounted simultaneously to the respective mounting holes of the air-intake pipes. Thus, the number of components is small, the assembly work is easy, and the superior assembleability is achieved.

According to an embodiment of the present invention, since the water drain holes are formed on the mounting holes formed on the air-intake pipes on the respective sides, even when the mounting holes of the air-intake pipes to which the injectors are fitted from above are formed to have a length sufficient for firmly holding the distal end portions of the injector, water drops or the like may be drained through the water drain holes so that accumulation may be avoided.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Referring now to FIG. 1 to FIG. 9, an embodiment of the present invention will be described.

Figure 1:
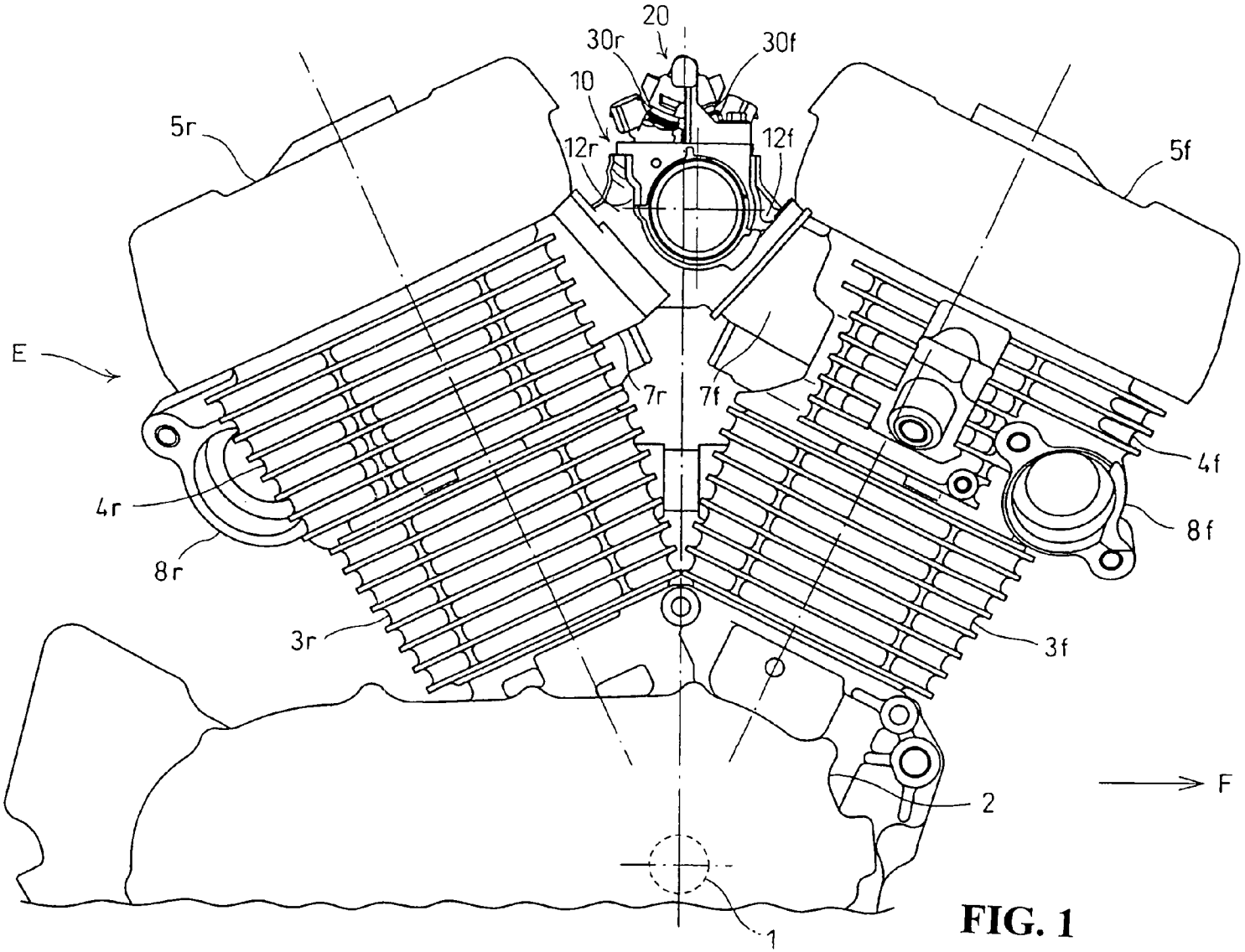
FIG. 1 is a side view of a V-type internal combustion engine according to an embodiment of the present invention.
Figure 2:
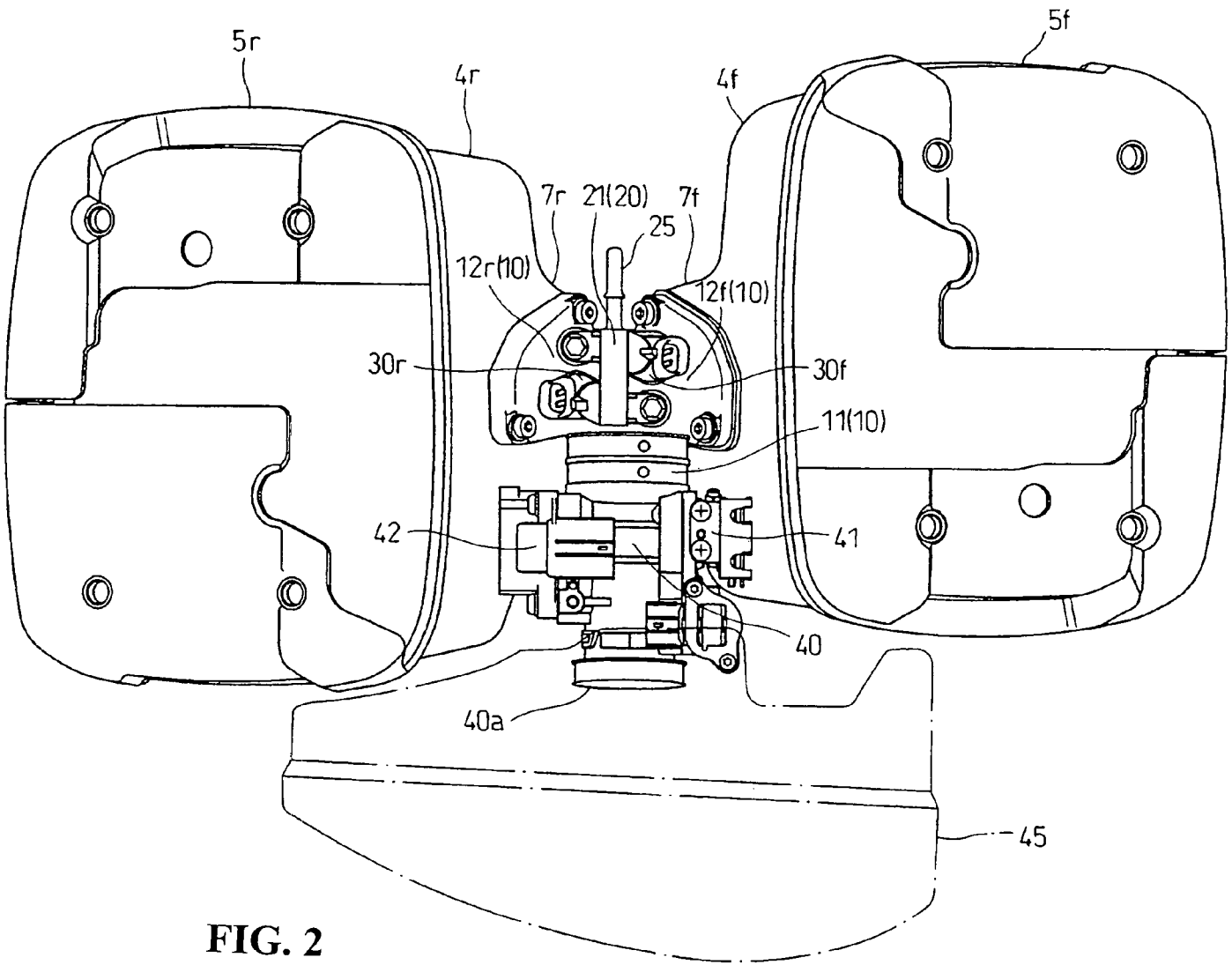
FIG. 2 is a top view of the same.

A V-type internal combustion engine E according to this embodiment is a two-cylinder water-cooled four-stroke internal combustion engine formed into a V-shape in the fore-and-aft direction, which is mounted transversely to a motorcycle with a crankshaft 1 oriented horizontally in the lateral direction. A top view of the V-type internal combustion engine E is shown in FIG. 1, and a right side view thereof is shown in FIG. 2.

In this embodiment, the front, rear, left, and right are defined based on the direction of travel of a vehicle.

The V-type internal combustion engine E includes a front bank cylinder 3*f* and a rear bank cylinder 3*r* extended obliquely upwardly from a crankcase 2, cylinder heads 4*f*, 4*r* placed on the front bank cylinder 3*f* and the rear bank cylinder 3*r* inclined in the fore-and-aft direction with cylinder head covers 5*f*, 5*r* covered respectively thereon.

A front air-intake port upstream opening end 7*f* of an air-intake port of the cylinder head 4*f* communicates with a combustion chamber of the front bank cylinder 3*f* projects into a V-bank. A front exhaust port downstream opening end 8*f* of an exhaust port which communicates with the same combustion chamber and projects obliquely rightwardly toward the front. On the other hand, a rear air-intake port upstream opening end 7*r* of the air-intake port of the cylinder head 4*r* which communicates with the combustion chamber of the rear bank cylinder 3*r* projects into the V-bank. A rear exhaust port downstream opening end 8*r* of the exhaust port which communicates with the combustion chamber projects obliquely rightwardly toward the rear.

An intake manifold 10 is connected to the front air-intake port upstream opening end 7*f* and the rear air-intake port upstream opening end 7*r* projecting into the V-bank. On the other hand, exhaust pipes, not shown, are connected respectively to the front exhaust port downstream opening end 8*f* and the rear exhaust port downstream opening end 8*r*.

Figure 3:
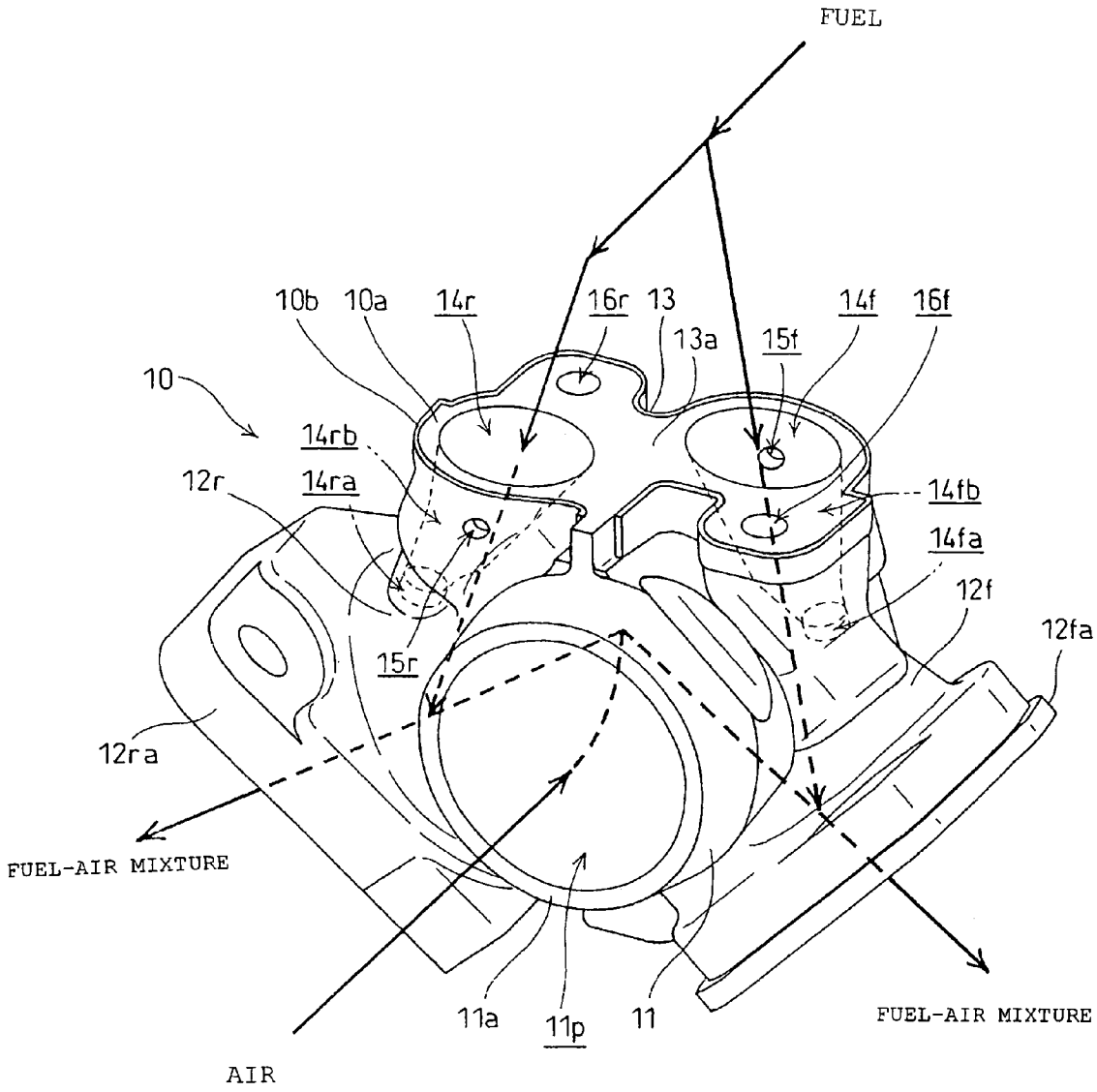
FIG. 3 is a perspective view of an intake manifold.
Figure 4:
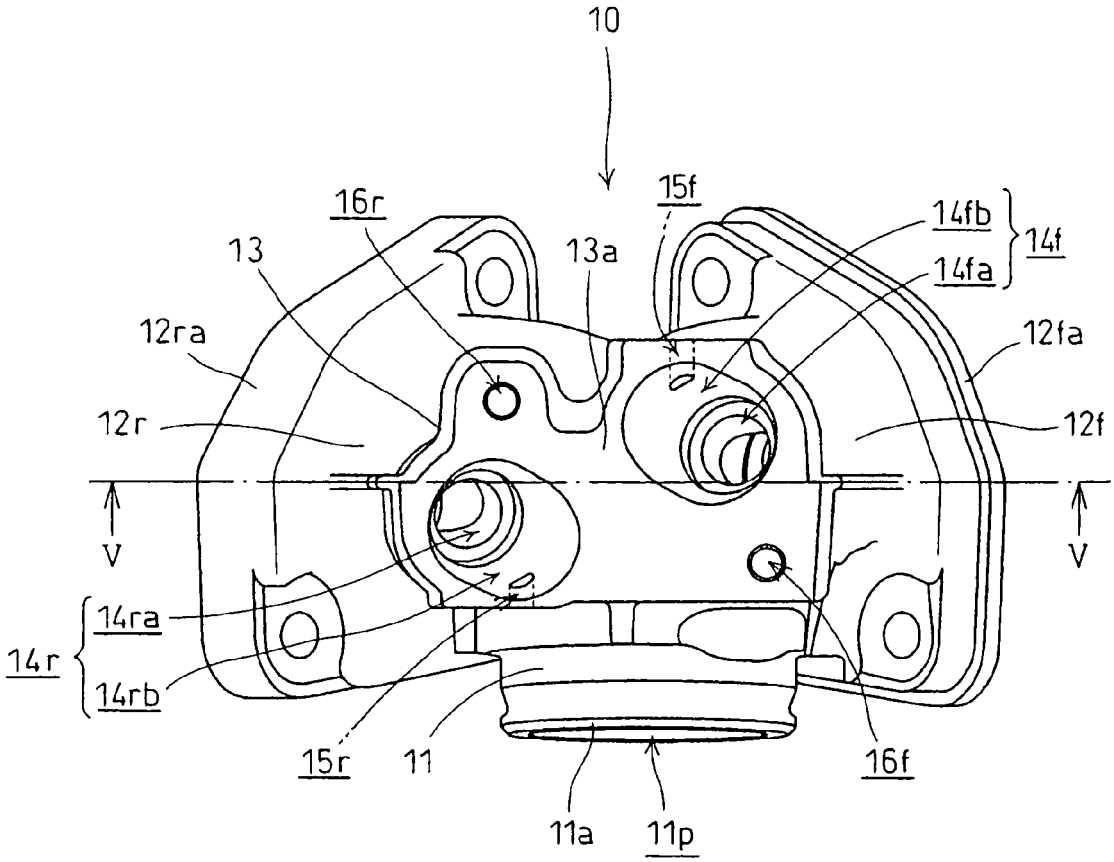
FIG. 4 is a top view of the intake manifold.
Figure 5:
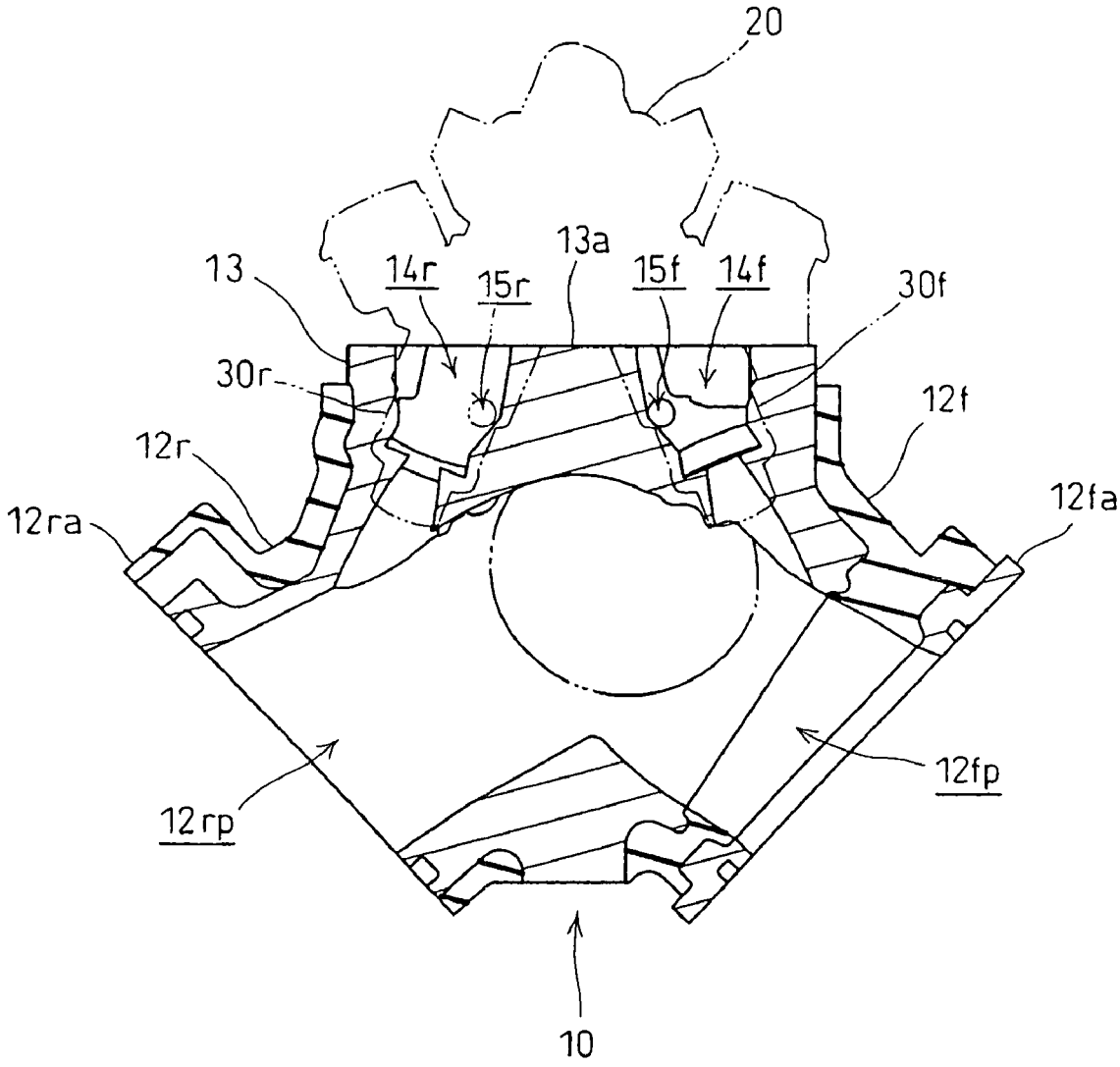
FIG. 5 is a cross-sectional view taken along the line V-V in FIG. 4.

Referring now to FIG. 3 to FIG. 5, the intake manifold 10 which is disposed in the V-bank oriented in the fore-and-aft direction is branched into a front air-intake pipe 12*f* and a rear air-intake pipe 12*r* extending obliquely downwardly toward the front and rear, respectively, from a common air-intake pipe 11 arranged in parallel to the crankshaft 1 horizontally so as to be oriented in the lateral direction. Front and rear opening end flange portions 12*fa*, 12*ra* of the front air-intake pipe 12*f* and the rear air-intake pipe 12*r* are connected respectively to the front air-intake port upstream opening end 7*f* and the rear air-intake port upstream opening end 7*r*. The intake manifold 10 is bridged between the front and rear cylinder heads 4*f*, 4*r*.

In this state, the common air-intake pipe 11 is oriented so that a joint opening 11*a* thereof faces to the right in the horizontal direction.

The common air-intake pipe 11 oriented horizontally in the lateral direction is branched into the front air-intake pipe 12*f* and the rear air-intake pipe 12*r* toward the front and rear, and a common air-intake passage 11*p* formed to the left from the joint opening 11*a* of the common air-intake pipe 11 communicates with a front air-intake channel 12*fp* of the front air-intake pipe 12*f* and a rear air-intake channel 12*rp* of the rear air-intake pipe 12*r*. In addition, the common air-intake passage 11*p* is branched into the front air-intake channel 12*fp* and the rear air-intake channel 12*rp* toward the front and rear, so that intake air flows therein.

A throttle body 40 is connected to the joint opening 11*a* oriented horizontally toward the right of the common air-intake pipe 11 of the intake manifold 10. An air-cleaner mounting opening 40*a* at the right end of the throttle body 40 is connected to an air cleaner 45 arranged on the right side of the front and rear cylinder heads 4*f*, 4*r* (see FIG. 2).

A throttle valve drive unit 41 is provided on the front side of the throttle body 40. A throttle opening sensor 42 projects on the rear side thereof.

The intake manifold 10 is formed with an injector mounting base 13 so as to swell upwardly and is connect the front air-intake pipe 12*f*. The rear air-intake pipe 12*r* extends in the fore-and-after direction across the common air-intake pipe 11 oriented horizontally in the lateral direction.

A flat mounting surface 13*a* is formed on an upper surface of the injector mounting base 13, and a front mounting hole 14*f* and a rear mounting hole 14*r* of the injector are formed through the mounting surface 13*a* at front and rear positions so as to be out of alignment from each other in terms of the lateral direction.

The front mounting hole 14*f* is formed obliquely downwardly from the front opening on the mounting surface 13*a* which is shifted to the left and opens into the front air-intake channel 12*fp* of the front air-intake pipe 12*f*. The rear mounting hole 14*r* is formed obliquely downwardly from the rear opening on the mounting surface 13*a* which is shifted to the right and opens into the rear air-intake channel 12*rp* of the rear air-intake pipe 12*r*.

The front mounting hole 14*f* is formed with a circular fitting hole 14*fa* having the smallest inner diameter for fitting the injector at the lower opening end thereof which opens into the front air-intake channel 12*fp* and is formed with a guide hole 14*fb* extending gradually obliquely upwardly toward the rear from the fitting hole 14*fa* so as to form a distorted funnel shape, and continues to an oval-shaped opening on the mounting surface 13*a*.

In the same manner, the rear mounting hole 14*r* is formed with a circular fitting hole 14*ra* having the smallest inner diameter for fitting the injector at the lower opening end thereof which opens into the rear air-intake channel 12*rp* and is formed with a guide hole 14*rb* extending gradually obliquely upwardly toward the front from the fitting hole 14*ra* so as to form a distorted funnel shape, and continues to an oval-shaped opening on the mounting surface 13*a*.

Formed on the respective tapered surfaces of the guide hole 14*fb* of the front mounting hole 14*f* and the guide hole 14*rb* of the rear mounting hole 14*r* are openings of a water drain holes 15*f*, 15*r* formed from the left and right side surfaces of the injector mounting base 13.

Formed on the right side of the front mounting hole 14*f* and the left side of the rear mounting hole 14*r* are screw holes 16*f*, 16*r* respectively so as to open through the mounting surface 13*a*.

The intake manifold 10 is formed by coating the outer surface of a metal portion 10*a* with a rubber coating layer 10*b*, placing the metal portion 10*a* in a metal die, injecting melted rubber in a layer space between the metal portion and the metal die, and causing the same to be cured.

A fuel supply device 20 is mounted to the injector mounting base 13 of the intake manifold 10.

Figure 6:
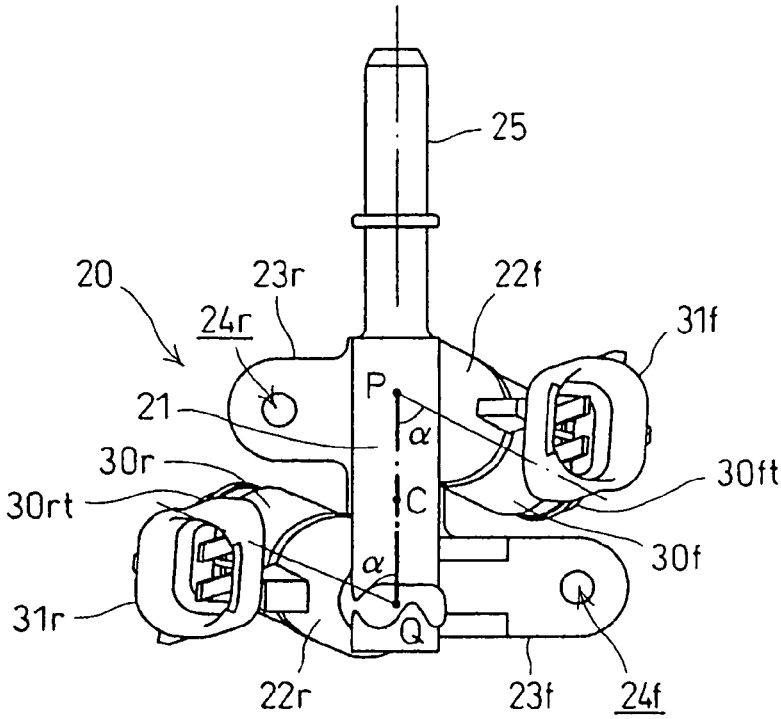
FIG. 6 is a top view of a fuel supply device.
Figure 7:
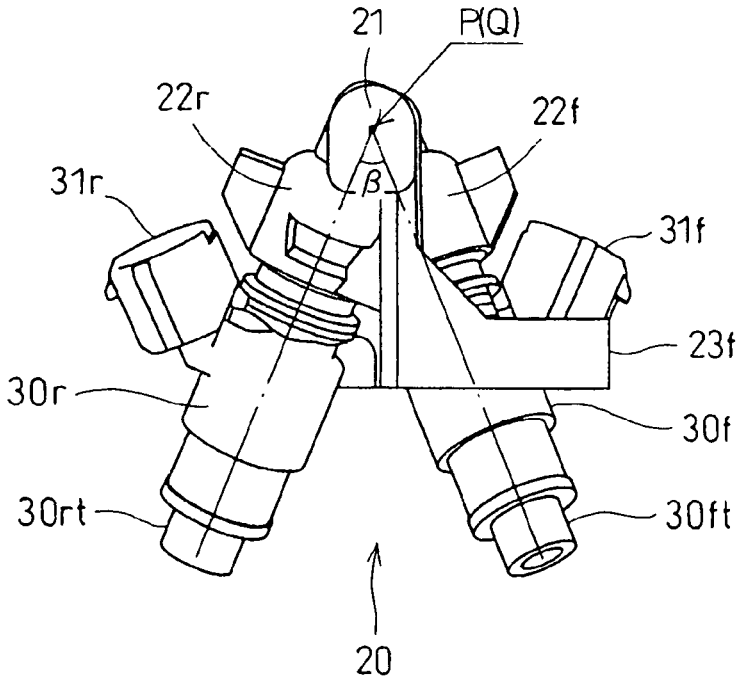
FIG. 7 is a side view of the same.

Referring now to FIGS. 6 and 7, the fuel supply device 20 is formed with a fuel supply pipe 21 at the center thereof, the fuel supply pipe 21 arranged horizontally in the lateral direction is formed with left and right injector mounting portions 22*f*, 22*r* so as to project obliquely downwardly respectively from two branched portions thereof which are apart from each other, and the proximal portions of a front injector 30*f* and a rear injector 30*r* are mounted to the respective injector mounting portions 22*f*, 22*r*.

The fuel supply pipe 21 is formed respectively with mounting brackets 23*r*, 23*f* on the opposite side from the injector mounting portions 22*f*, 22*r* so as to project therefrom, and the lower surfaces of the mounting brackets 23*r*, 23*f* are flat and come into abutment with the mounting surface 13*a* of the injector mounting base 13 of the intake manifold 10.

The mounting brackets 23*f*, 23*r* are formed with mounting holes 24*f*, 24*r* corresponding to screw holes 16*f*, 16*r*.

The injectors 30*f*, 30*r* include cylindrical distal end portions 30*ft*, 30*rt* with a reduced diameter, and are provided at the center portion thereof with couplers 31*f*, 31*r* for connecting power cables.

A connecting pipe 25 extends to the left from a branched portion 21L of the fuel supply pipe 21.

Referring now to FIGS. 6 and 7, assuming that the point where the center axis of the front injector 30*f* intersects with the center axis of the fuel supply pipe 21 is a point P, and the point where the center axis of the rear injector 30*r* intersects therewith is a point Q, the point P and the point Q are branch points of the front injector 30*f* and the rear injector 30*r* from the fuel supply pipe 21.

In a top view shown in FIG. 6, the front injector 30*f* and the rear injector 30*r* extend obliquely with respect to a segment PQ which connects the branch point P and the branch point Q apart from each other in the direction of the axis of the fuel supply pipe 21 at an acute angle $\alpha$ and in parallel to each other.

In the top view, the front injector 30*f* and the rear injector 30*r* are arranged in point symmetry with respect to a center point C of the segment PQ.

In a side view of the fuel supply pipe 21 viewed in the direction of the axial line thereof shown in FIG. 7, the front injector 30*f* and the rear injector 30*r* extend so as to branch from the fuel supply pipe 21 in an inverted V-shape. An angle $\beta$ formed by the inverted V-shape is an acute angle (see FIG. 7).

In this manner, the front injector 30*f* and the rear injector 30*r* mounted to the injector mounting portions 22*f*, 22*r* of the fuel supply pipe 21 respectively and branched therefrom are attached to the front mounting hole 14*f* and the rear mounting hole 14*r* of the intake manifold 10 respectively.

In this mounting procedure, the distal end portion 30*ft* of the front injector 30*f* is fitted to the fitting hole 14*fa* of the front mounting hole 14*f* of the intake manifold 10 and the distal end portion 30*rt* of the rear injector 30*r* is fitted to the fitting hole 14*ra* of the rear mounting hole 14*r*.

In this injector mounting structure, the front injector 30*f* and the rear injector 30*r* can be mounted respectively to the front mounting hole 14*f* and the rear mounting hole 14*r* of the intake manifold 10 simultaneously in a state in which the front injector 30*f* and the rear injector 30*r* are mounted to the fuel supply pipe 21 (the state shown in FIG. 6 and FIG. 7).

A method of mounting the fuel supply device 20 to the intake manifold 10 will now be described.

Figure 8:
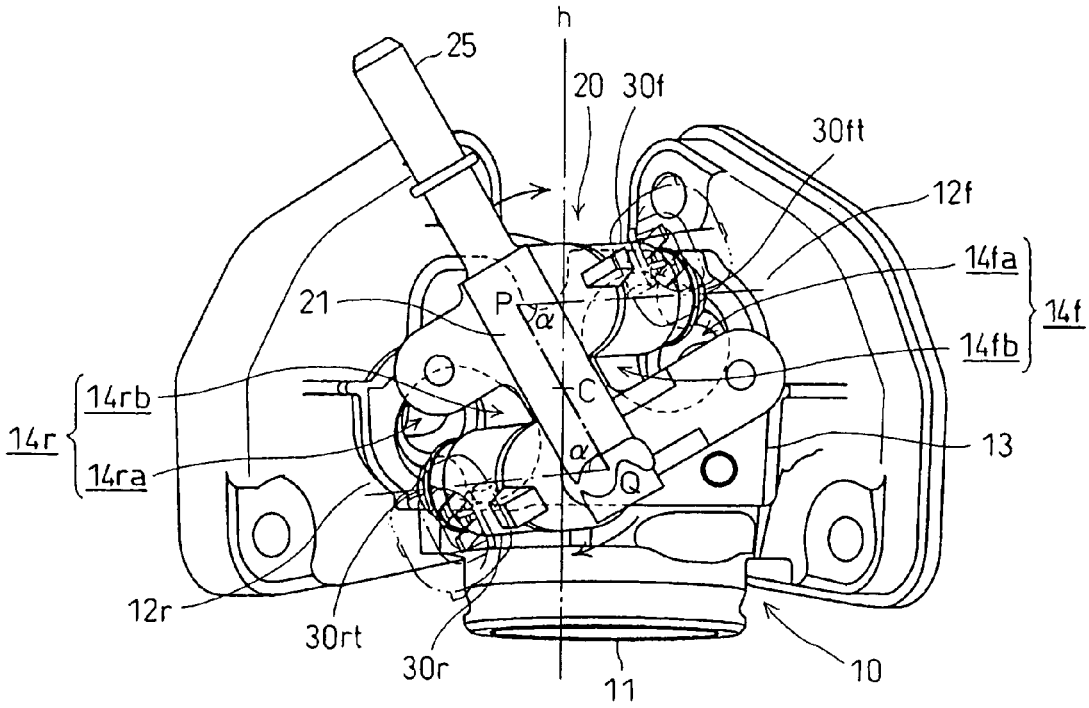
FIG. 8 is a top view showing a state in which the fuel supply device is arranged at a required position above the intake manifold.

The fuel supply device 20 in the state in which the front injector 30*f* and the rear injector 30*r* are mounted to the fuel supply pipe 21 is arranged over the injector mounting base 13 of the intake manifold 10 as shown in FIG. 8.

In other words, the center point C of the segment PQ of the fuel supply pipe 21 is overlapped with the center point of the segment connecting the center of the opening of the distal end surface of the fitting hole 14*fa* of the front mounting hole 14*f* and the center of the opening surface of the distal end of the fitting hole 14*ra* of the rear mounting hole 14*r* on the injector mounting base 13 in top view. As shown in the top view in FIG. 8, the distal end portion 30*ft* of the front injector 30*f* is brought into proximity or contact with the tapered surface of the guide hole 14*fb* of the front mounting hole 14*f* and, simultaneously, the distal end portion 30*rt* of the rear injector 30*r* is brought into proximity or contact with the tapered surface of the guide hole 14*rb* of the rear mounting hole 14*r*.

At this time, as shown in FIG. 8, the fuel supply pipe 21 is in a posture rotated by a certain angle counterclockwise about the center point C with respect to a lateral horizontal line h which passes through the center point C in top view.

In FIG. 8, the couplers 31*f*, 31*r* projecting from the front injector 30*f* and the rear injector 30*r* are omitted for making the distal end portions 30*ft*, 30*rt* easily visible.

When the fuel supply device 20 is rotated clockwise and moved downwardly simultaneously from this state, the distal end portion 30*ft* which moves ahead of the rotation of the front injector 30*f* enters the guide hole 14*fb* of the front mounting hole 14*f* along the tapered surface thereof while following a helical track, then reaches the fitting hole 14*fa* and is fitted thereto and, simultaneously, the distal end portion 30*rt* which moves ahead of the rotation of the rear injector 30*r* enters the guide hole 14*rb* of the rear mounting hole 14*r* along the tapered surface thereof while following a helical track, then reaches the fitting hole 14*ra* and is fitted thereto, so that the front injector 30*f* and the rear injector 30*r* are simultaneously fitted to the front mounting hole 14*f* of the front air-intake pipe 12*f* and the rear mounting hole 14*r* of the rear air-intake pipe 12*r* respectively.

In this state, the direction in which the fuel supply pipe 21 is oriented corresponds to the lateral horizontal line h (see FIG. 9), and the lower surfaces of the mounting brackets 23*f*, 23*r* come into abutment with the mounting surface 13*a* of the injector mounting base 13 of the intake manifold 10, and the mounting holes 24*f*, 24*r* of the mounting brackets 23*f*, 23*r* correspond to the screw holes 16*f*, 16*r* of the injector mounting base 13, respectively.

Figure 9:
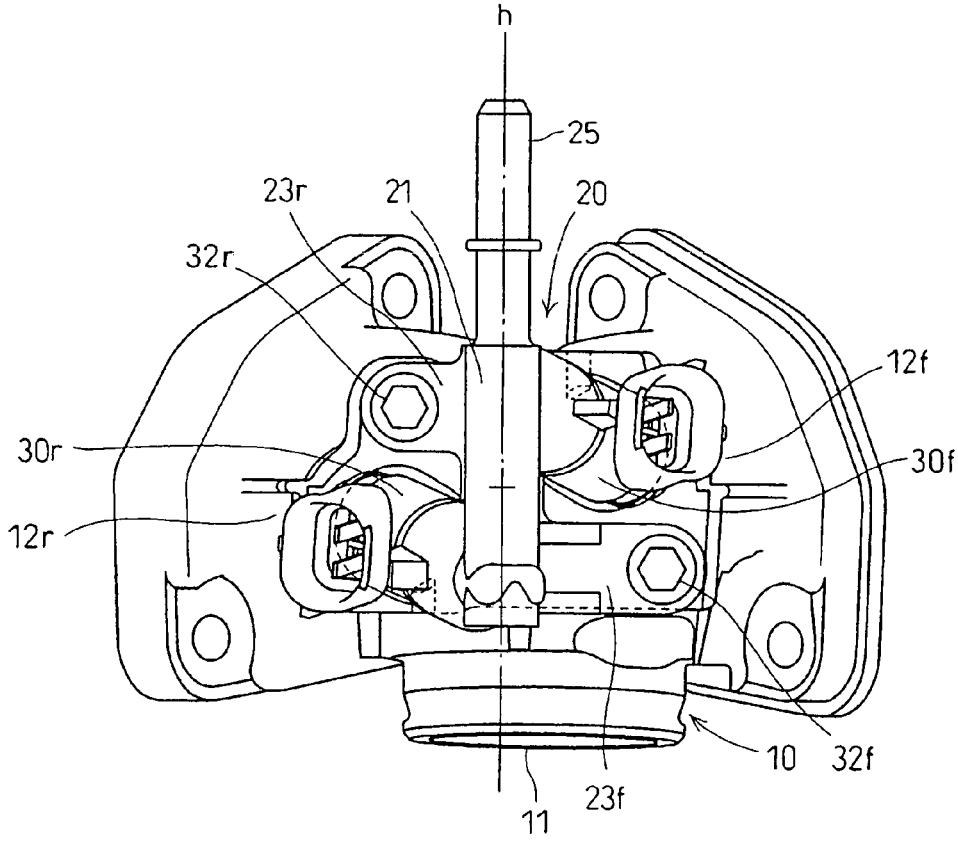
FIG. 9 is a top view of a state in which the fuel supply device is attached to the intake manifold.

Bolts 32*f*, 32*r* are inserted respectively to the mounting holes 24*f*, 24*r* of the mounting brackets 23*f*, 23*r* of the fuel supply device 20, are screwed into the screw holes 16*f*, 16*r* of the injector mounting base 13, and are tightened, so that the fuel supply device 20 is mounted to the injector mounting base 13 of the intake manifold 10, as shown in FIG. 9.

According to the fuel supply device 20, since the front injector 30*f* and the rear injector 30*r* are mounted to the fuel supply pipe 21 as described above, the fuel supply device 20, a pair of the injectors 30*f*, 30*r* can be mounted to the respective mounting holes 14*f*, 14*r* of the front and rear air-intake pipes 12*f*, 12*r* simultaneously, so that the number of components is small, the assembly work is easy, and superior assembleability is achieved.

When the front injector 30*f* and the rear injector 30*r* are driven at a predetermined timing in a state in which the fuel pipe is connected to the connecting pipe 25 projecting to the left from the fuel supply pipe 21 and fuel is pumped to the fuel supply pipe 21, the fuel is injected and mixed with intake air from the air cleaner 45 which is adjusted in the throttle body 40, and distributed to the front air-intake pipe 12*f* and the rear air-intake pipe 12*r*. The fuel-air mixture is supplied to the respective combustion chambers in the front bank cylinder 3*f* and the rear bank cylinder 3*r* at a predetermined timing (see an arrow in FIG. 3), which is provided for explosion in the front and rear combustion chambers in the internal combustion engine E.

The guide holes 14*fb*, 14*rb* of the front mounting hole 14*f* and the rear mounting hole 14*r*, which are spread upwardly into a distorted funnel shape, have wide spread openings respectively at the upper ends thereof which are wider than the front injector 30*f* and the rear injector 30*r*. Thus, gaps are formed even though the front injector 30*f* and the rear injector 30*r* are mounted respectively. Therefore, water drops or the like may be trapped therein. However, since the respective tapered surfaces of the guide holes 14*fb*, 14*rb* are formed with the water drain holes 15*f*, 15*r* for draining the trapped water, so that accumulation of water is avoided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An injector mounting structure for a V-type internal combustion engine in which an intake manifold is arranged in a V-bank formed between cylinders arranged on the respective sides so as to be inclined to form a V-shape for sucking air to the respective cylinders, comprising:

a fuel supply pipe disposed in the V-bank and being oriented in parallel to a crankshaft and extending linearly; and a pair of injectors branched from two branch portions spaced apart from each other in the direction of an axial line of the fuel supply pipe into an inverted V-shape in a side view from a direction of the axial line of the fuel supply pipe and extending in parallel to each other and obliquely at an acute angle with respect to a segment connecting the two branch portions in top view;

wherein the injectors are mounted by fitting respective distal end portions of the pair of injectors respectively to mounting holes formed on front and rear air-intake pipes on the respective sides of the intake manifold, wherein an intake channel of the front air-intake pipe has a length different from the length of an intake channel of the rear air-intake pipe.

2. The injector mounting structure for a V-type internal combustion engine according to claim 1, wherein the mounting holes formed on the air-intake pipes on the respective sides are formed with water drain holes respectively.

3. The injector mounting structure for a V-type internal combustion engine according to claim 1, wherein each of said air-intake pipes includes a front air-intake port upstream opening end of an air-intake port of the cylinders in communication with a combustion chamber of a front bank cylinder.

4. The injector mounting structure for a V-type internal combustion engine according to claim 3, wherein a front exhaust port downstream opening end of an exhaust port communicates with the front bank cylinder.

5. The injector mounting structure for a V-type internal combustion engine according to claim 1, wherein each of said air-intake pipes includes a rear air-intake port upstream opening end of an air-intake port of the cylinders in communication with a combustion chamber of a rear bank cylinder.

6. The injector mounting structure for a V-type internal combustion engine according to claim 5, wherein a rear exhaust port downstream opening end of an exhaust port communicates with the rear bank cylinder.

7. The injector mounting structure for a V-type internal combustion engine according to claim 3, wherein the intake manifold is connected to the front air-intake port upstream opening end and projects into the V-bank.

8. The injector mounting structure for a V-type internal combustion engine according to claim 5, wherein the intake manifold is connected to the rear air-intake port upstream opening end and projects into the V-bank.

9. The injector mounting structure for a V-type internal combustion engine according to claim 1, further comprising:

a common air-intake pipe extending parallel to the crankshaft, wherein a front injector and a rear injector are arranged symmetric with respect to a center point with respect to a portion of the fuel supply pipe, wherein the common air-intake pipe is closer to the one side of the V-bank than to the other side of the V-bank.

10. The injector mounting structure for a V-type internal combustion engine according to claim 1, wherein a front injector and a rear injector extend from the fuel supply pipe in an inverted V-shape.

11. An injector mounting structure for use with a V-type internal combustion engine comprising:

an air intake manifold arranged in a V-bank formed between cylinders;

a fuel supply pipe disposed in the V-bank and being oriented in parallel to a crankshaft and extending linearly; and a pair of injectors branched from the fuel supply pipe and being spaced apart from each other in a direction of an axial line of the fuel supply pipe into an inverted V-shape in a side view from the direction of the axial line of the fuel supply pipe and extending in parallel to each other and obliquely at an acute angle with respect to a segment connecting the two branch portions in top view; and a common air-intake pipe extending parallel to the crankshaft and located closer to one of two sides of the V-bank, wherein said injectors being mounted by fitting respective distal end portions of the pair of injectors respectively to mounting holes formed on air-intake pipes on the respective sides of the intake manifold.

12. The injector mounting structure for use with a V-type internal combustion engine according to claim 11, wherein the mounting holes formed on the air-intake pipes on the respective sides are formed with water drain holes respectively.

13. The injector mounting structure for use with a V-type internal combustion engine according to claim 11, wherein each of said air-intake pipes includes a front air-intake port upstream opening end of an air-intake port of the cylinders in communication with a combustion chamber of a front bank cylinder.

14. The injector mounting structure for use with a V-type internal combustion engine according to claim 13, wherein a front exhaust port downstream opening end of an exhaust port communicates with the front bank cylinder.

15. The injector mounting structure for use with a V-type internal combustion engine according to claim 11, wherein each of said air-intake pipes includes a rear air-intake port upstream opening end of an air-intake port of the cylinders in communication with a combustion chamber of a rear bank cylinder.

16. The injector mounting structure for use with a V-type internal combustion engine according to claim 15, wherein a rear exhaust port downstream opening end of an exhaust port communicates with the rear bank cylinder.

17. The injector mounting structure for use with a V-type internal combustion engine according to claim 13, wherein the intake manifold is connected to the front air-intake port upstream opening end and projects into the V-bank.

18. The injector mounting structure for use with a V-type internal combustion engine according to claim 15, wherein the intake manifold is connected to the rear air-intake port upstream opening end and projects into the V-bank.

19. The injector mounting structure for use with a V-type internal combustion engine according to claim 11, wherein a front injector and a rear injector are arranged symmetric with respect to a center point with respect to a portion of the fuel supply pip;

wherein one of the fuel supply pipe and the common air-intake pipe is closer to the one side of the V-bank than to the other side of the V-bank.

20. The injector mounting structure for use with a V-type internal combustion engine according to claim 11, wherein a front injector and a rear injector extend from the fuel supply pipe in an inverted V-shape.

* * * * *